US012486674B2

(12) United States Patent
Goodson

(10) Patent No.: US 12,486,674 B2
(45) Date of Patent: Dec. 2, 2025

(54) FELT TILES AND TILE KITS

(71) Applicant: FeltRight, LLC, Salt Lake City, UT (US)

(72) Inventor: Talley Goodson, Salt Lake City, UT (US)

(73) Assignee: FeltRight, LLC, Draper, UT (US)

( * ) Notice: Subject to any disclaimer, the term of this patent is extended or adjusted under 35 U.S.C. 154(b) by 175 days.

(21) Appl. No.: 18/445,670

(22) Filed: May 5, 2021

(65) Prior Publication Data

US 2025/0027324 A1 Jan. 23, 2025

(51) Int. Cl.
*E04F 15/02* (2006.01)

(52) U.S. Cl.
CPC .. *E04F 15/02161* (2013.01); *E04F 15/02155* (2013.01)

(58) Field of Classification Search
CPC ..... E04F 15/02161; E04F 15/02155
See application file for complete search history.

(56) References Cited

U.S. PATENT DOCUMENTS 9,145,681 B2 * 9/2015 Hannig ..... E04C 2/388
10,030,394 B2 * 7/2018 Simoens ..... E04F 15/107
10,889,995 B2 * 1/2021 Midorikawa-Haelters ..... E04F 13/0889
12,006,701 B2 * 6/2024 Boo ..... E04F 15/102
2009/0133348 A1 * 5/2009 Gibson ..... E04F 15/02033 52/392
2023/0175271 A1 * 6/2023 Buhlmann ..... C09D 7/41 52/578

FOREIGN PATENT DOCUMENTS

DE 20313226 U1 * 5/2004 ..... E04F 13/0862

* cited by examiner

*Primary Examiner* — Andrew J Triggs
(74) *Attorney, Agent, or Firm* — Workman Nydegger

(57) ABSTRACT

A tile for decorating a substantially flat surface can comprise a rigid body made of fibers. In one implementation, the body has a top surface and a bottom surface that are parallel to each other. The bottom surface can be configured to be attached to a substantially flat surface. An area of the top surface can be smaller than an area of the bottom surface. In one implementation, the distance between the top surface and the bottom surface is a thickness of the tile, which is no greater than 1 inch. A tile kit can include a plurality of the tiles. Each of the plurality of the tiles has a color selected from a plurality of predetermined colors, a shape selected from a plurality of predetermined shapes, or a pattern selected from a plurality of predetermined patterns. The plurality of tiles can be configured to form one or more designs.

15 Claims, 15 Drawing Sheets

700

6X6
6X6
6X6

800

900

FELT TILES AND TILE KITS

CROSS-REFERENCE TO RELATED APPLICATIONS

N/A

BACKGROUND

People often decorate their walls with canvas art, framed art, photo frames, decorative tiles, and more. However, most wall décor is not customizable. Further, most wall décor requires tools to install and is not child-friendly. In particular, making and installing decorative tiles requires a significant amount of work and skill. For example, spacers, nails, and/or tapes may be required to keep tiles in place during installation because the weight of tiles tends to pull them down during installation. Further, various tools (e.g., knife, drill, wet saw, hammer, trowel, tile adhesive, caulking) may be required to apply tile adhesives, cut tiles, place the tiles, and fill gaps between the tiles.

BRIEF SUMMARY

This Summary is provided to introduce a selection of concepts in a simplified form that is further described below in the Detailed Description. This Summary is not intended to identify key features or essential features of the claimed subject matter, nor is it intended to be used as an aid in determining the scope of the claimed subject matter.

For example, a tile can comprise a rigid body made of fibers, wherein the body has a top surface and a bottom surface that are parallel to each other; the bottom surface is configured to be attached to a substantially flat surface; an area of the top surface is smaller than an area of the bottom surface; a distance between the top surface and the bottom surface is a thickness of the tile; and the thickness is no greater than 1 inch.

Similarly, a tile kit can comprise a plurality of the aforementioned tiles, wherein each of the plurality of tiles has a color selected from the plurality of predetermined colors and a shape selected from the plurality of predetermined shapes; and the plurality of tiles is configured to form one or more designs.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and details through the use of the accompanying drawings in which.

DETAILED DESCRIPTION

Figure 1A:
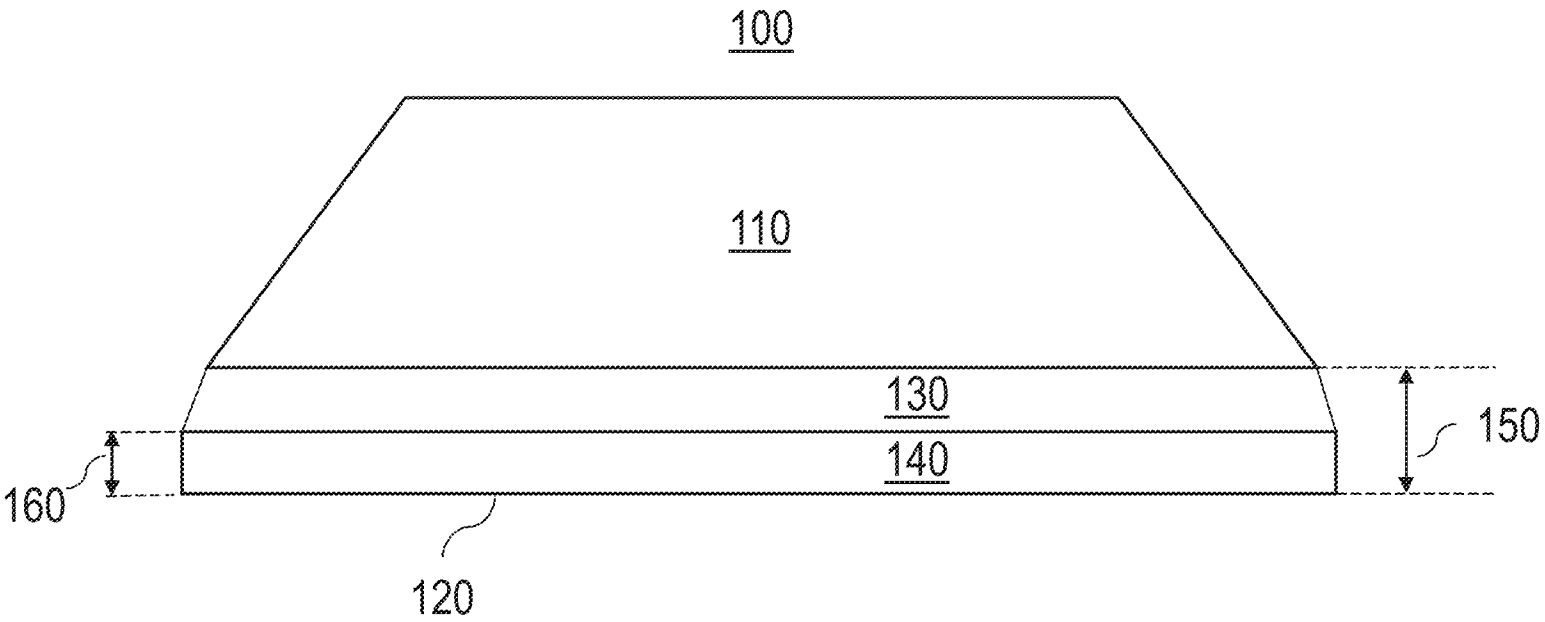
FIGS. 1A and 1B illustrate perspective views of a rectangular shaped tile having chamfered edges.

The embodiments described herein are related to tiles made of fibers (such as felt tiles) and tile kits. Each tile can have a rigid body. The tiles described herein (also referred to as felt tiles) can be used to cover a portion of a wall surface as decorative wall décor and/or visually appealing bulletin boards. Alternatively, or in addition, the tiles described herein can be used to cover a whole wall surface or floor surface completely to build an acoustic room with custom designs.

In some embodiments, the body can be made with at least 50% recycled content. The body has a top surface and a bottom surface that are parallel to each other. A distance between the top surface and the bottom surface is a thickness of the tile. In some embodiments, the thickness can be no greater than 1 inch. In some embodiments, the thickness of the body is about 1/10 of an inch to about 1/2 of an inch, preferably about 1/3 of an inch. An area of the top surface is smaller than an area of the bottom surface. In some embodiments, the body of the tile can have at least one chamfered edge.

The chamfered edges or other designed edges give the tiles an aesthetic appeal. Especially, each tile may be made slightly different in thickness or dimension. The chamfered edges or other designed edges mitigates such imperfections and improve appearance of the overall design.

In some embodiments, the body of the tile can have a plurality of side surfaces connecting the top surface and the bottom surface. At least one of the plurality of side surfaces (which may be flat or not flat) and the top surface or the bottom surface form an acute angle.

In some embodiments, the top surface and the bottom surface can be geometrically similar, but the top surface is smaller than the bottom surface. In some embodiments, the plurality of side surfaces can include a first set of side surfaces and a second set of side surfaces. The first set of side surfaces are directly connected to the top surface, and the second set of side surfaces are directly connected to the bottom surface.

In some embodiments, the first set of side surfaces and the top surface can form an acute angle (i.e., the first set of side surfaces are not perpendicular to the top surface or the bottom surface), and the second set of side surfaces can be perpendicular to the top surface or the bottom surface. In some embodiments, the first set of side surfaces and the second set of side surfaces can be directly connected to each other to form chamfered edges. In some embodiments, each of the first set of side surfaces and the top surface form an angle of about 30 degrees to about 60 degrees, preferably about 45 degrees. In some embodiments, each of the second set of side surfaces has a width that is about 30% to about 70%, preferably about 50% of the thickness of the body.

In some embodiments, the top surface further can include one or more grooves that form a pattern. The grooved pattern is configured to divide the top surface into a plurality of sections, causing the tile to appear to be a plurality of smaller tiles when viewed from a side of the top surface.

In some embodiments, the body of the tile has a particular color, a particular shape, and/or a particular pattern. The particular color is selected from a plurality of predetermined colors, the particular shape is selected from a plurality of predetermined shapes, and the particular pattern is selected from a plurality of predetermined patterns.

In some embodiments, a plurality of tiles can be assembled into a tile kit. Each of the plurality of tiles has a color selected from the plurality of predetermined colors, a shape selected from the plurality of predetermined shapes, and a pattern selected from the plurality of predetermined patterns. The plurality of tiles is configured to form one or more designs.

In some embodiments, the tile kit can further include one or more adhesive devices configured to attach the plurality of tiles onto a substantially flat surface (e.g., a wall or a floor). In some embodiments, the one or more adhesive devices can include a plurality of double-sided adhesive tabs. One side of the double-sided adhesive tabs is configured to be attached on the bottom surface of each of the plurality of tiles, and another side of the double-sided adhesive tabs is configured to be attached onto the substantially flat surface. In some embodiments, the one or more adhesive devices can include glue.

In some embodiments, the tile kit can further include an instruction document having instructions for installing the tile kit. In some embodiments, the instruction document can show an arrangement of the design formed by the plurality of tiles in the tile kit. In some embodiments, the instruction document can show an instruction for applying the one or more adhesive devices. For example, for each of the plurality of shapes, the instruction document can show one or more locations on a tile having the shape, where the adhesive devices should be applied.

Figure 1B:
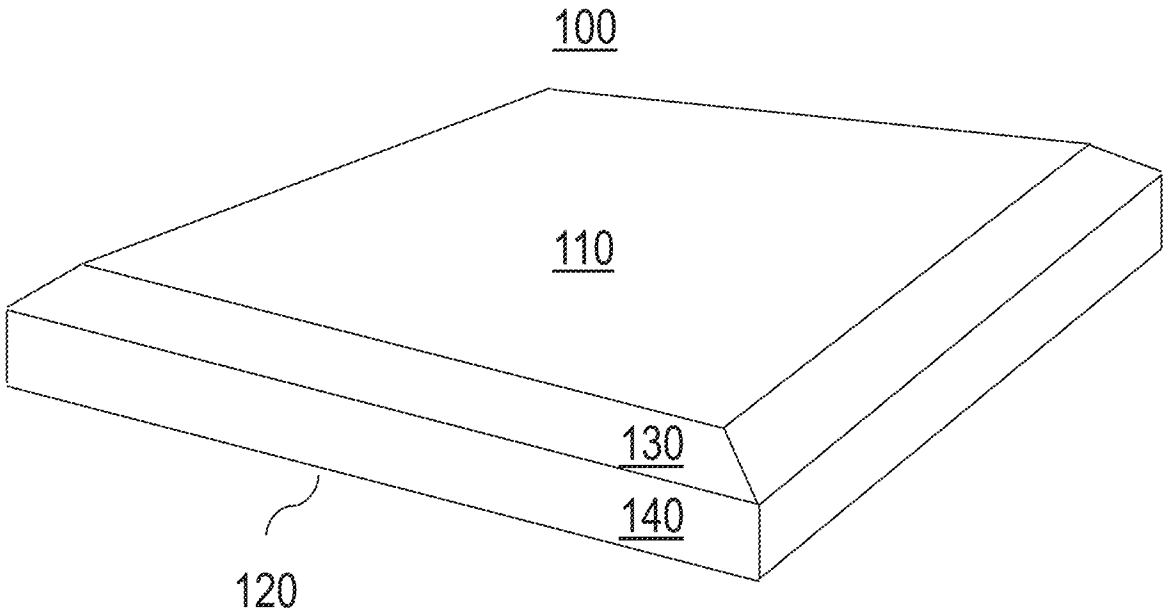

FIGS. 1A and 1B illustrate perspective views of a rectangular-shaped felt tile having a rigid body 100. The rigid body 100 includes a top surface 110 and a bottom surface 120 that are parallel to each other. A distance between the top surface 110 and the bottom surface is a thickness 150 of the felt tile. In some embodiments, the thickness 150 is no greater than 1 inch. In some embodiments, the thickness 150 of the body is about 1/10 to about ½ inch, preferably about ⅓ inches. An area of the top surface 110 is smaller than an area of the bottom surface 120. In some embodiments, the body 100 has at least one chamfered edge 130, 140. In some embodiments, each edge of the body 100 is chamfered. For example, all four edges of the body 100 of the rectangular-shaped felt tile is chamfered.

The chamfered edges or other designed edges give the felt tiles an aesthetic appeal. Especially, each felt tile may be made slightly different in thickness or dimension. The chamfered edges or other designed edges mitigates such imperfections and improve appearance of the overall design.

In some embodiments, the body 100 of the felt tile has multiple side surfaces 130, 140 connecting the top surface 110 and the bottom surface 120. At least one of the multiple side surfaces 130, 140 is not perpendicular to the top surface 110 or the bottom surface 120.

In some embodiments, the top surface 110 and the bottom surface 120 are geometrically similar, but the top surface 110 is smaller than the bottom surface 120. For example, in some embodiments, the top surface 110 and the bottom surface 120 are both square-shaped, rectangular-shaped, or triangular-shaped; however, the top surface 110 is smaller than the bottom surface 120.

In some embodiments, the multiple sides surfaces 130, 140 include a first set of side surfaces 130 and a second set of side surfaces 140. The first set of side surfaces 130 are directly connected to the top surface 110, and the second set of side surfaces 140 are directly connected to the bottom surface 120.

In some embodiments, the first set of side surfaces 130 forms an acute angle with the top surface 110, and the second set of side surface 140 are perpendicular to the top surface 110 or the bottom surface 120. In some embodiments, the first set of side surfaces and the second set of side surfaces are directly connected to each other to form chamfered edges or fillet edges. In some embodiments, each of the first set of side surfaces 130 and the top surface 110 form an angle of about 30 degrees to about 60 degrees, preferably about 45 degrees. In some embodiments, each of the second set of side surfaces has a width 160 that is about 30% to about 70%, preferably about 50%, of the thickness 150 of the body.

Figure 2:
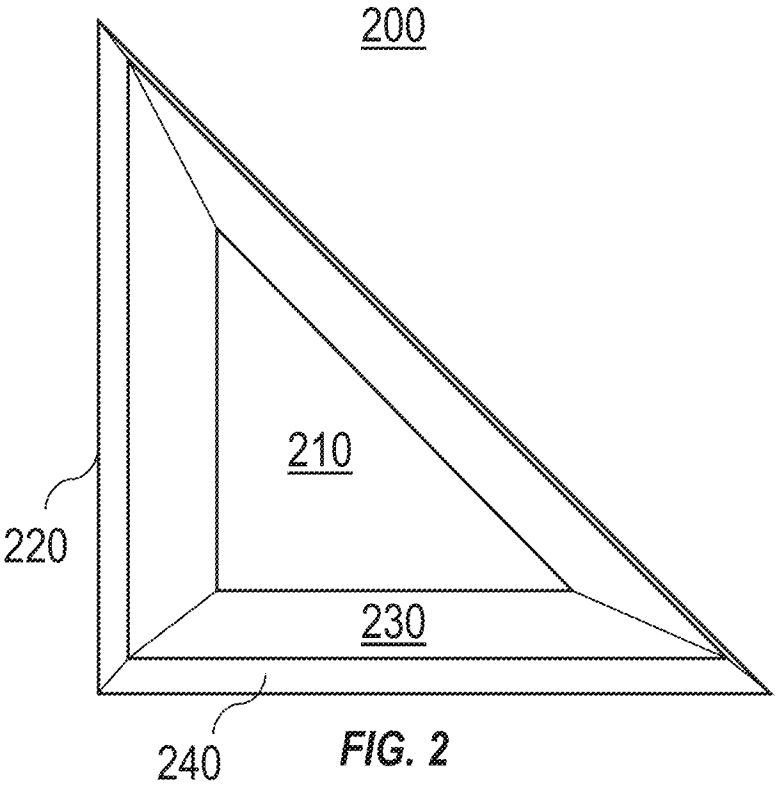
FIG. 2 illustrates a perspective view of a triangular shaped tile having chamfered edges.

FIG. 2 illustrates a perspective view of a felt tile having a triangular-shaped body 200. The triangular-shaped body includes a top surface 210, a bottom surface 220, and multiple side surfaces 230, 240. As illustrated, similar to the rectangular-shaped body 100 in FIGS. 1A and 1B, the side surfaces 230, 240 of the triangular-shaped body 200 also form chamfered edges. The top surface 210 and the bottom surface 220 are also geometrically similar, but the top surface 210 is a smaller triangle compared to the bottom surface 220. In some embodiments, each of the top surface 210 and the bottom surface 220 is a right triangle and/or an isosceles triangle having two equal sides. In some embodiments, each of the top surface 210 and the bottom surface 220 is an equilateral triangle having all three sides equal to each other.

Figure 3A:
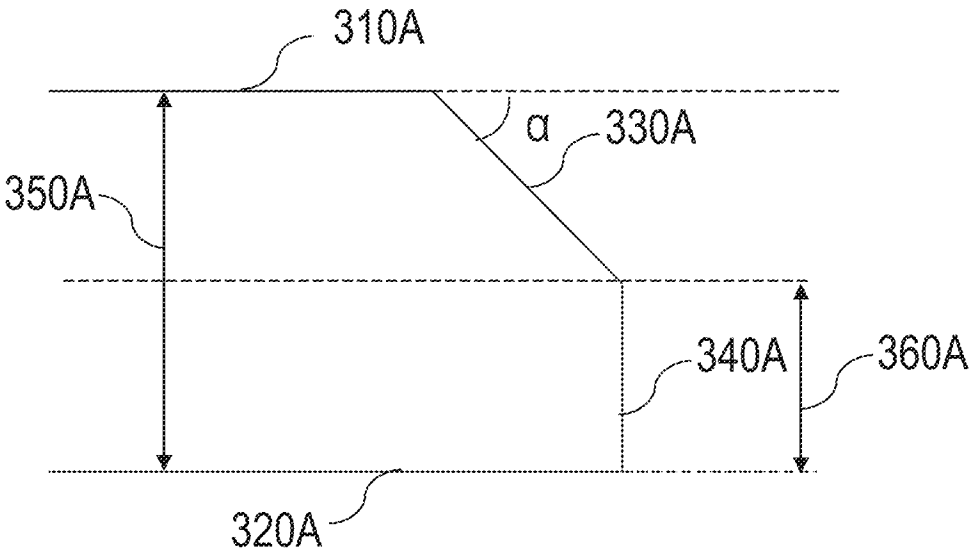
FIG. 3A illustrates a side view of a chamfered edge that may be implemented on a tile.

FIG. 3A illustrates a side view of a chamfered edge 300A which may be formed at an edge of a felt tile (e.g., felt tile 100 or 200). The chamfered edge 300A is formed by a top surface 310A, a bottom surface 320A, a first side surface 330A, and a second side surface 340A. The side surfaces 330A and 340A may correspond to side surfaces 130, 140, or 230, 240. As illustrated in FIG. 3A, the first side surface 330A forms an acute angle α with the top surface 310A. In some embodiments, the angle α is about 45 degrees. The second side surface 340A is perpendicular to the bottom surface 320A. In some embodiments, a ratio between a width 360A of the second side surface 340A and the thickness 350A of the body of the felt tile is predetermined. For example, in some embodiments, the width 360A is about 30% to about 70%, preferably about 50%, of the thickness 350A of the body of the felt tile.

Figure 3B:
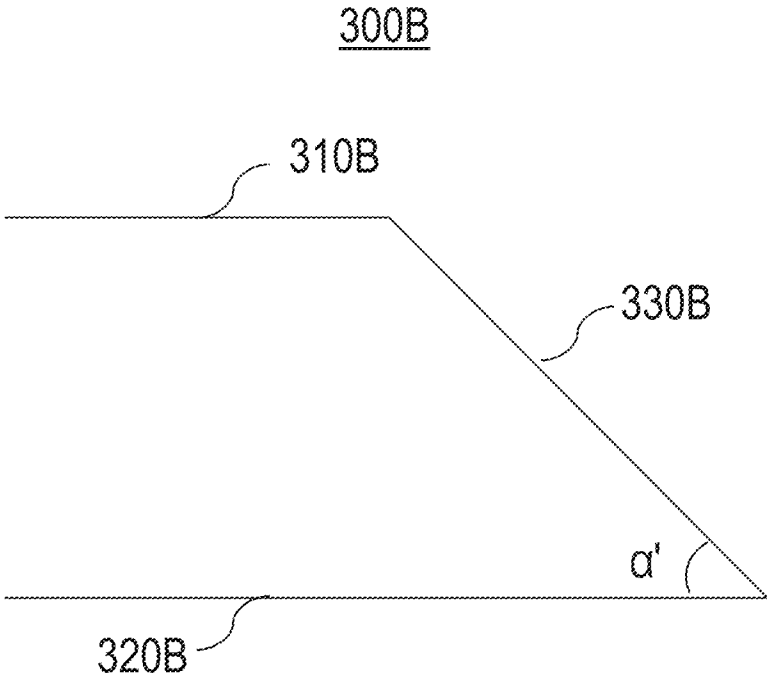
FIG. 3B illustrates a side view of a beveled edge that may be implemented on a tile.

In some embodiments, a body of a felt tile has a beveled edge. FIG. 3B illustrates a beveled edge 300B, which may be formed at an edge of a body of a felt tile. The beveled edge 300B is formed by a top surface 310B, a bottom surface 320B, and a side surface 330B. The bottom surface 320B and the side surface 330B form an acute angle α'. In some embodiments, the angle α' is about 30 degrees to about 60 degrees, preferably about 45 degrees.

Figure 3C:
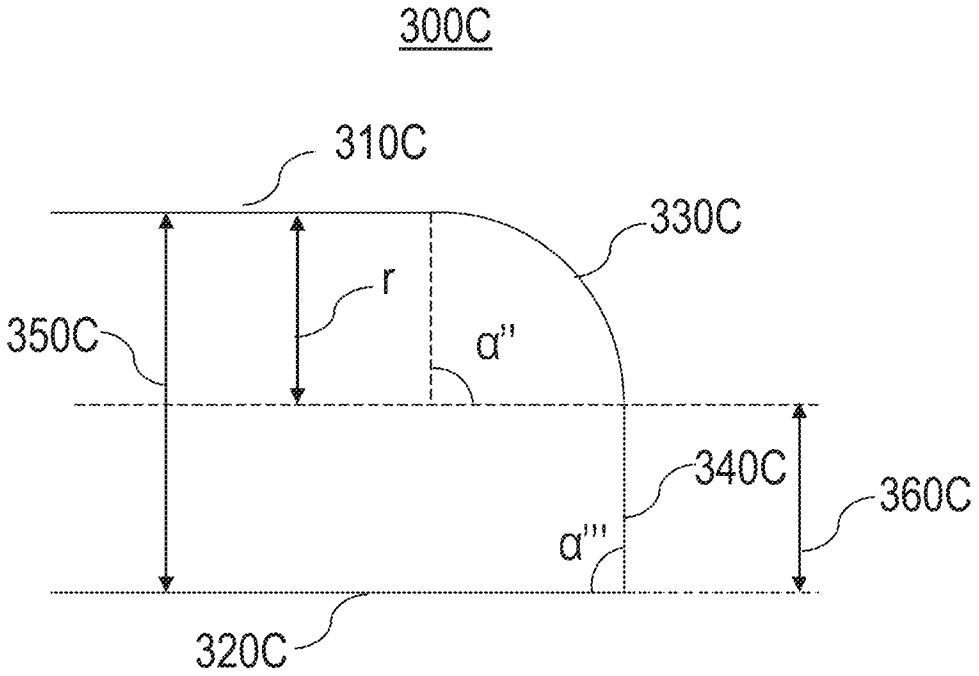
FIG. 3C illustrates a side view of a fillet edge that may be implemented on a tile.

In some embodiments, a body of a felt tile has a fillet edge. FIG. 3C illustrates a fillet edge 300C which may be formed at an edge of a body of a felt tile. The fillet edge 300C is formed by a top surface 310C, a bottom surface 320C, a curved side surface 330C, and a flat side surface 340C. In some embodiments, a width 360C of the flat side surface bout 30% to about 70%, preferably about 50%, of the thickness 350C of the felt tile. In some embodiments, the curved side surface 330C is an arc of a circle. In some embodiments, an angle α" of the arc is about 60 degrees to about 120 degrees, preferably 90 degrees of a circle having a radius r, where r substantially equals the thickness 350C minus the width 360C of the flat side surface 340C. As illustrated, the flat surface 340C is perpendicular to the bottom surface 320C, i.e., the flat side surface 340C and the bottom surface 320C form a right angle α'''. Even though α" and α''' illustrated in FIG. 3C are both right angles (i.e., 90 degrees), it is not necessary that α" and α''' are both 90 degrees. In some embodiments, neither a" nor α''' is 90 degrees. In some embodiments, only one of α" or α''' is 90 degrees.

Figure 3D:
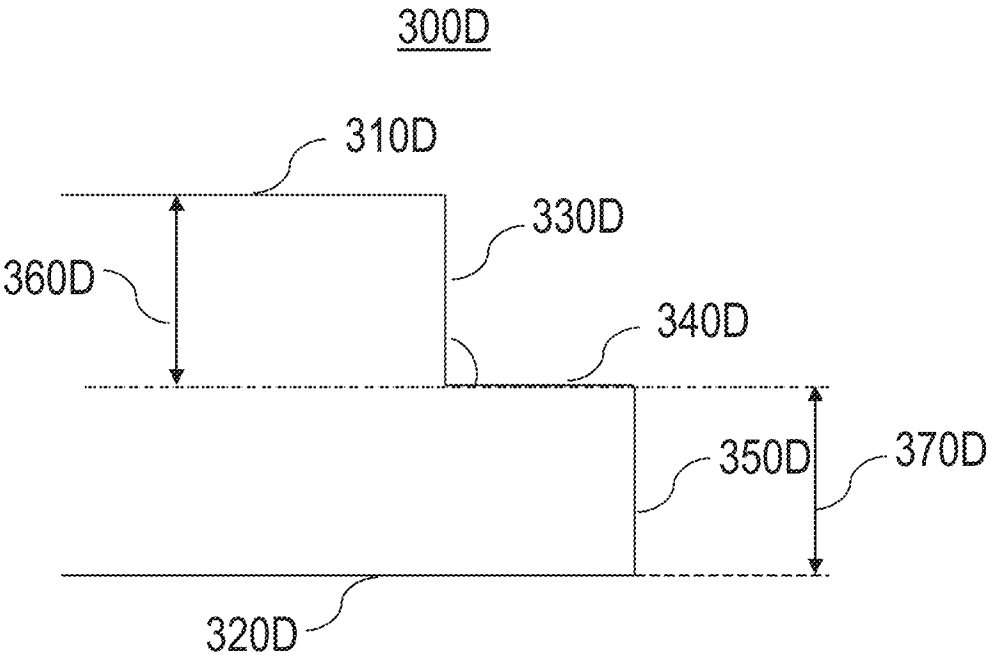
FIG. 3D illustrates a side view of a stepped edge that may be implemented on a tile.

In some embodiments, a body of a felt tile has a stepped edge. FIG. 3D illustrates a stepped edge that may be formed at an edge of a felt tile. The stepped edge 300D is formed by a top surface 310D, a bottom surface 320D, a first side surface 330D, a second side surface 340D, and a third side surface 350D. As illustrated, the first side surface 330D and the third side surface 350D are perpendicular to the top surface 310D or the bottom surface 320D. The second side surface 340D is parallel to the top surface 310D and the bottom surface 320D. As such, a stepped edge is formed at an edge of the body of the felt tile. In some embodiments, a width 360D of the first side surface 330D and a width 370D of the third side surface 350D are substantially same, or have a particular ratio.

Even though the first side surface 330D and the third side surface 350D illustrated in FIG. 3D are perpendicular to the top surface 310D or 320D, and the second side surface 340D illustrated in FIG. 3D is parallel to the top surface 310D or the bottom surface 320D, these limitations are not necessary. In some embodiments, the first side surface 330D or the third side surface 350D can form an acute angle with the top surface 310D or the bottom surface 320D. Alternatively, or in addition, in some embodiments, the second side surface 340D can intersect the top surface 310D or the bottom surface 320D.

Figure 3E:
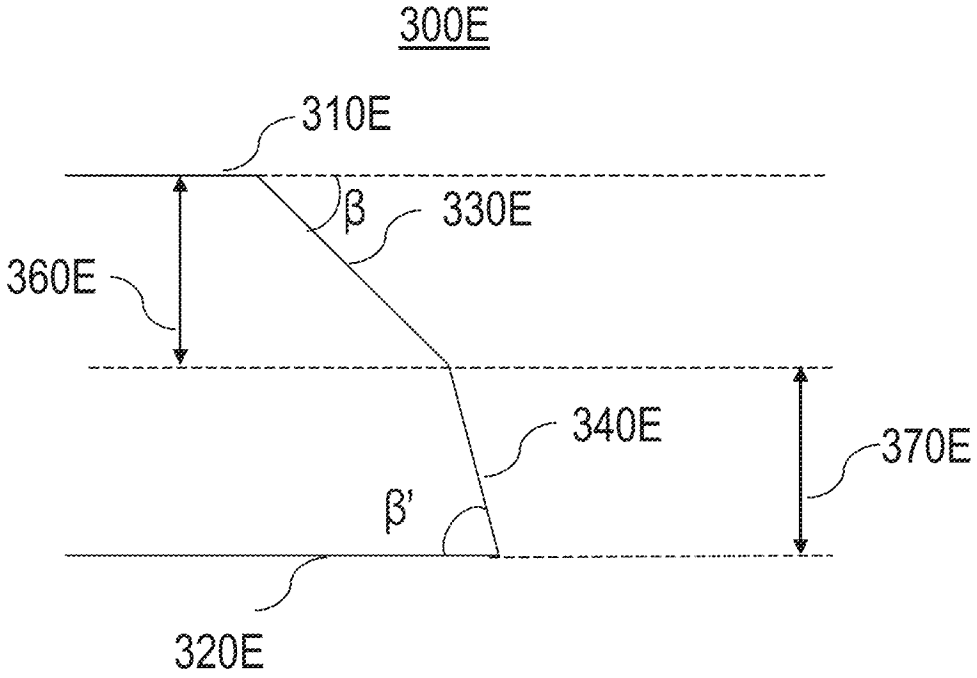
FIG. 3E illustrates a side view of a double-beveled edge that may be implemented on a tile.

In some embodiments, a body of a felt tile has a double-beveled edge. FIG. 3E illustrates a double-beveled edge that may be formed at an edge of a felt tile. The double-beveled edge 300E is formed by a top surface 310E, a bottom surface 320E, a first side surface 330E, and a second side surface 340E. As illustrated, the first side surface 330E or the second side surface 340E forms an acute angle with the top surface 310E or the bottom surface 320E. The top surface 310E and the first side surface 330E form a first acute angle β, and the bottom surface 320E and the second side surface 340E form a second acute angle β'. In some embodiments, β is a smaller angle than β'; in some embodiments, β is a greater angle than β'. Further, the first side surface 330E has a first thickness 360E, and the second side surface 340E has a second thickness 370E. In some embodiments, the first thickness 360E and the second thickness 370E have a predetermined ratio. In some embodiments, the first thickness 360E and the second thickness are about the same.

Figure 4:
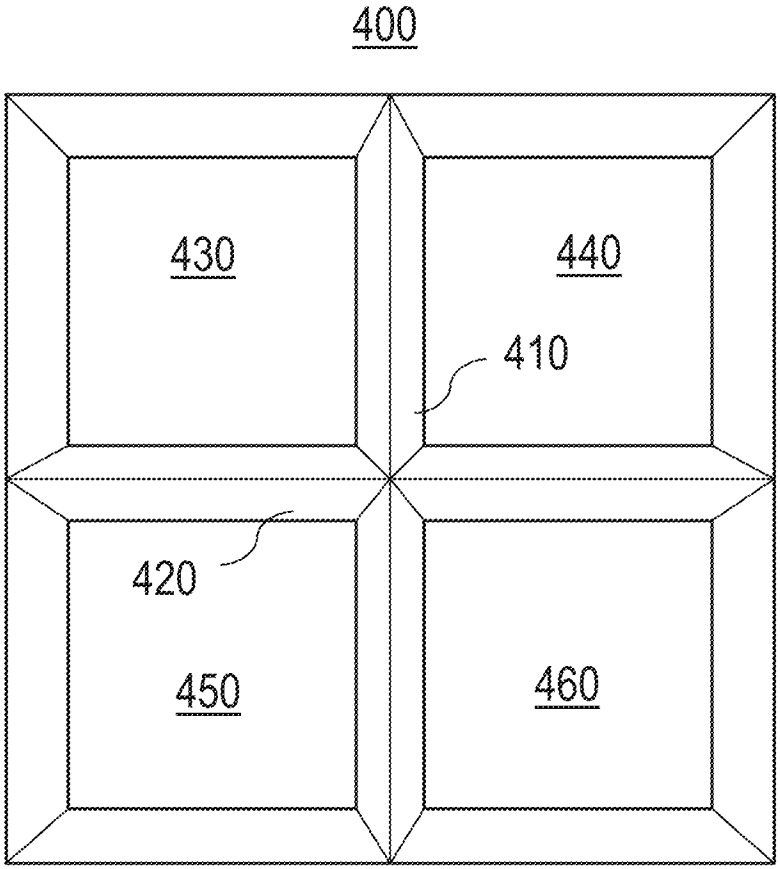
FIG. 4 illustrates an example of a tile having a grooved pattern that divides a top surface of the tile into multiple sections, causing the tile appears to be multiple smaller tiles when viewed from a side of the top surface.

In some embodiments, a top surface of a body of a felt tile has one or more grooves that form a pattern. The pattern is configured to divide the top surface into a plurality of sections, causing the felt tile to appear to be multiple smaller felt tiles when viewed from a side of the top surface. FIG. 4 illustrates an example of a top surface of a felt tile 400, including a first groove 410 and a second groove 420 that divide the top surface into four equal sections 430, 440, 450, and 460. The grooves 420 (also referred to as a grooved pattern) cause the felt tile to appear to be 4 smaller felt tiles when viewed from the top surface.

Figure 5:
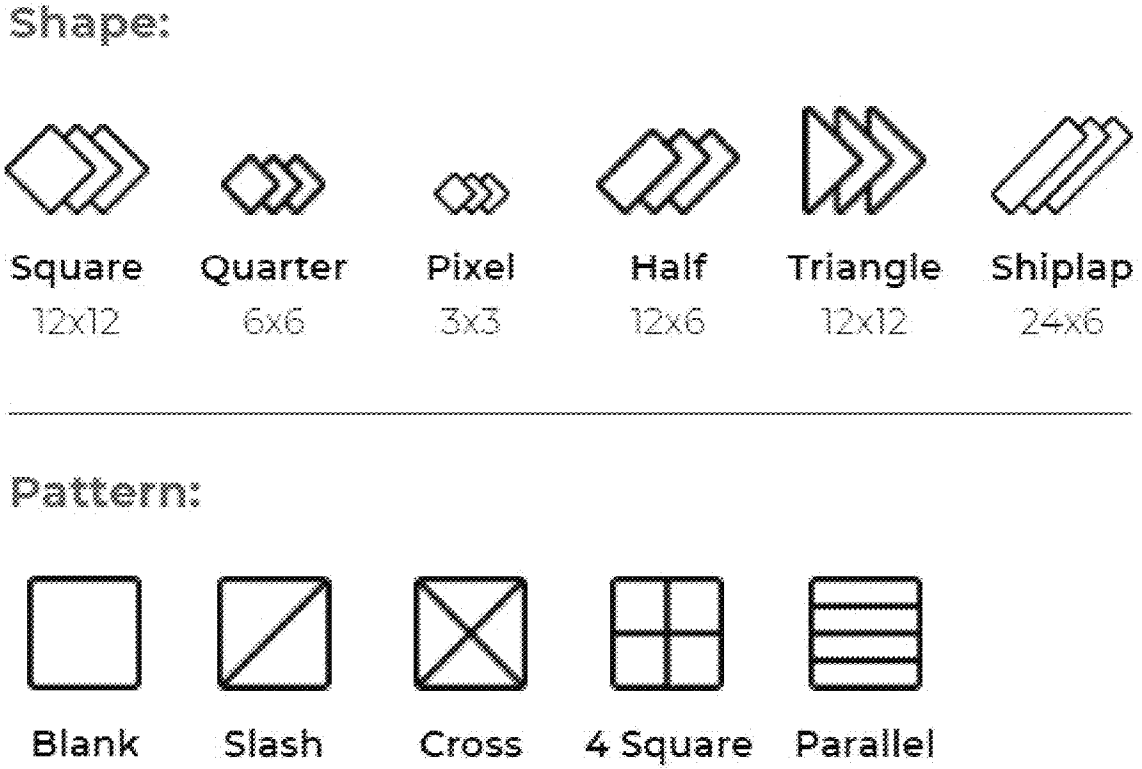
FIG. 5 illustrates an example of a set of predetermined shapes and patterns that a tile may have.

In some embodiments, each felt tile has a particular shape selected from a set of predetermined shapes and a pattern selected from a set of predetermined groove patterns. FIG. 5 illustrates an example of a set 500 of predetermined shapes and patterns. The multiple predetermined shapes may include (but are not limited to) a 12×12-inch square (also referred to as "square"), a 6×6-inch square (also referred to as "quarter"), a 3×3-inch square (also referred to as "pixel"), a 12×6 rectangle (also referred to as "half"), a 12×12 triangle (also referred to as "triangle"), and a 24×6 rectangle (also referred to as "shiplap"). The multiple patterns include a square with no groove (also referred to as "blank"), a square having a single diagonal groove (also referred to as "slash"), a square having two diagonal grooves (also referred to as "cross"), a square having two center cross grooves (also referred to as "4-square"), and a square having three parallel grooves (also referred to as "parallel").

As illustrated, the slash pattern divides a square felt tile into two triangle sections, causing the square felt tile to appear to be two triangle felt tiles. The cross pattern divides a square felt tile into four small triangle sections, causing the square felt tile to appear to be four small triangle felt tiles. The 4-square pattern divides a square felt tile into four square sections, causing the square felt tile to appear to be four quarter felt tiles. The parallel pattern divides a square felt tile into four small rectangle sections, causing the square felt tile to appear to be four small rectangular felt tiles.

Figure 6:
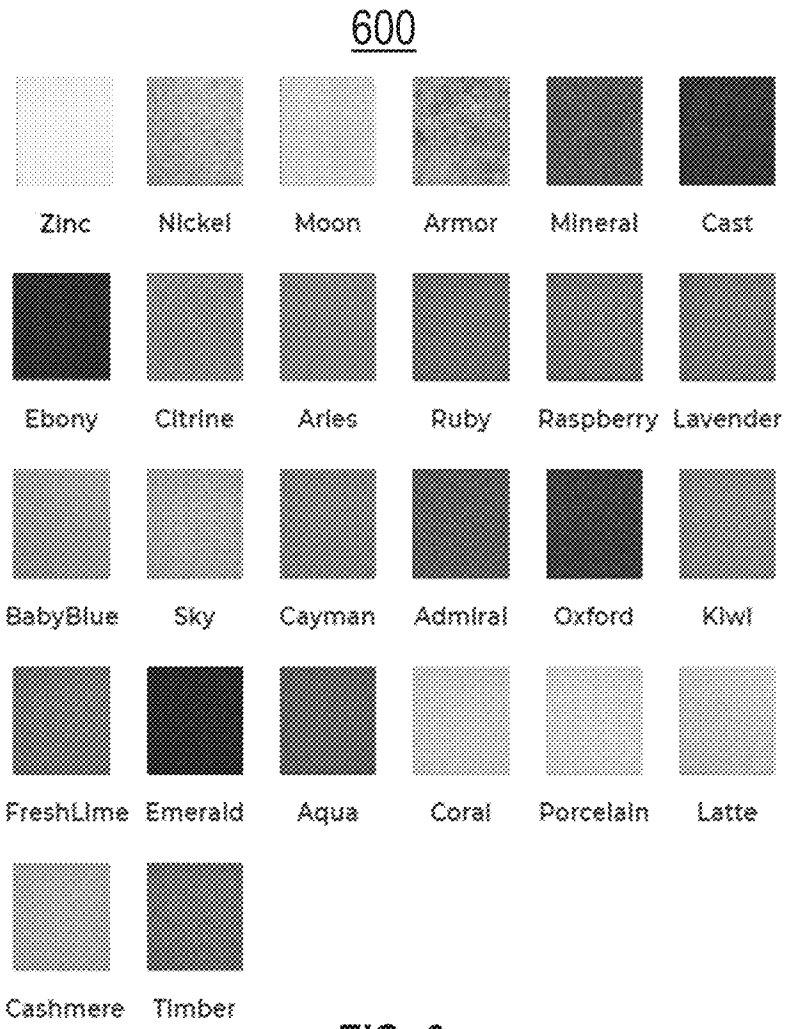
FIG. 6 illustrates an example of a set of predetermined colors that a tile may have.

In some embodiments, each felt tile has a color selected from a set of predetermined colors. FIG. 6 illustrates an example of a set of predetermined colors 600. The set of predetermined colors may include (but are not limited to) colors zinc, nickel, moon, armor, mineral, cast, ebony, citrine, arles, ruby, raspberry, lavender, baby blue, sky, cayman, admiral, oxford, kiwi, fresh lime, emerald, aqua, coral, porcelain, latte, cashmere, and timber.

In some embodiments, a set of felt tiles are assembled in a felt tile kit. Each of the set of titles has a color selected from a set of predetermined colors (e.g., the set of predetermined colors 600 of FIG. 6), a shape selected from a set of predetermined shapes (e.g., the set of predetermined shapes shown in FIG. 5), and a pattern selected from a set of predetermined patterns (e.g., the set of predetermined patterns shown in FIG. 5). The set of felt tiles are configured to form one or more designs.

Figure 7:
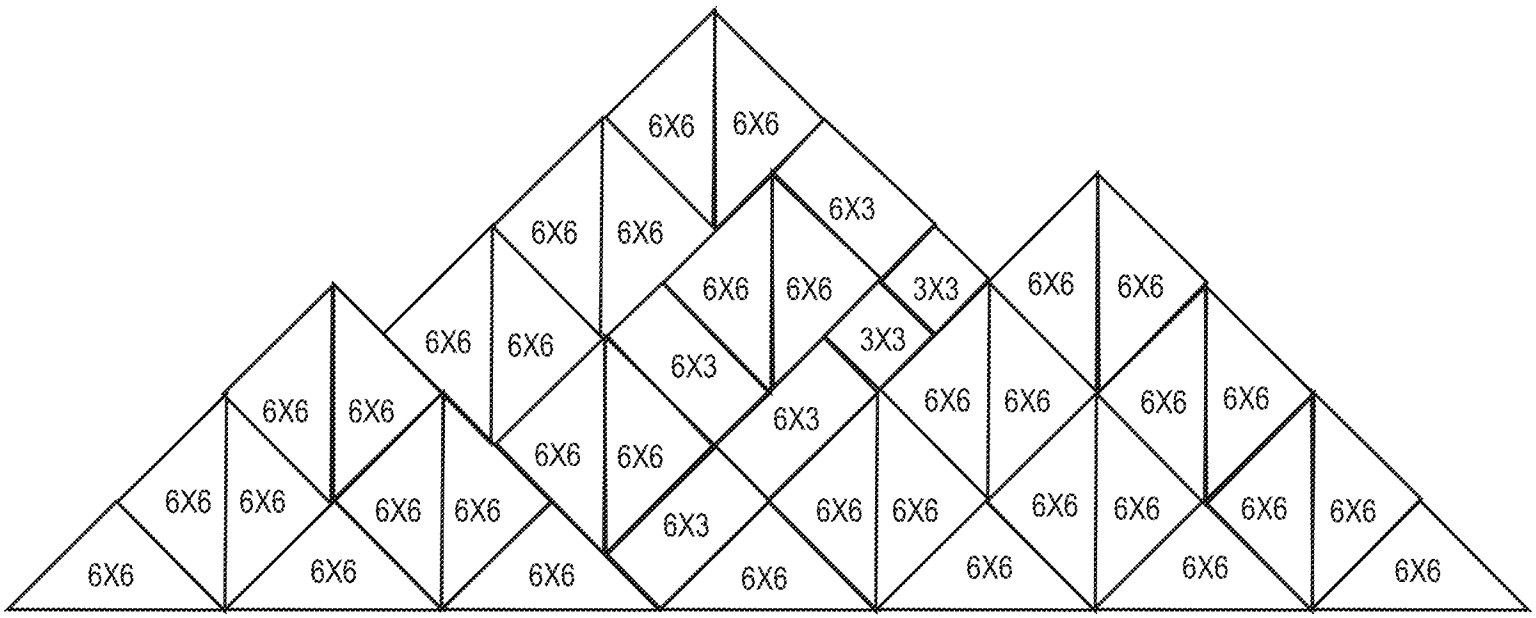
FIG. 7 illustrates an example of a mountain design formed by tiles of predetermined shapes, which may be included in a tile kit.
Figure 8:
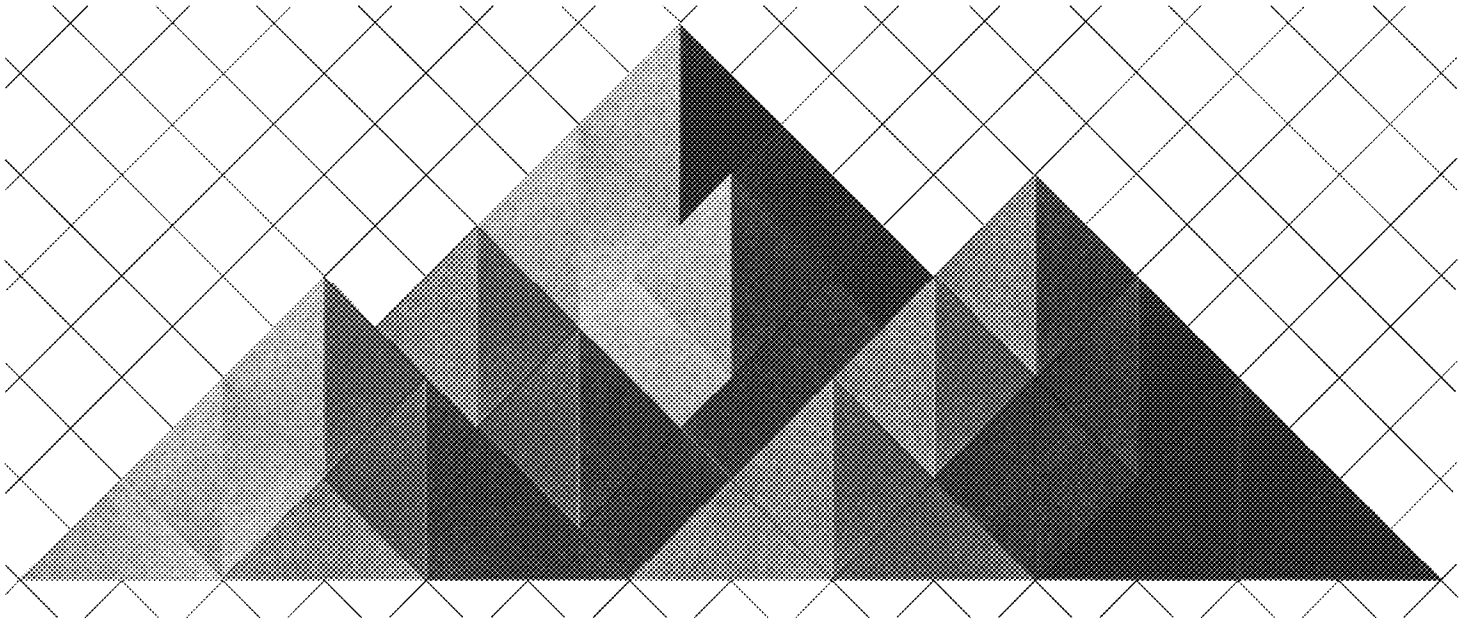
FIG. 8 illustrates an example of a colored image of a mountain design formed by tiles of predetermined shapes.

FIG. 7 illustrates a mountain design 700 formed by multiple 6×6-inch triangle felt tiles, 6×3-inch rectangular felt tiles, and 3×3-inch square felt tiles. FIG. 8 illustrates a colored image of a mountain design 800 (corresponding to the mountain design 700 of FIG. 7), showing the colors of the different felt tiles. The mountain design 700 is merely an example of a design. With all the different colors, shapes, and patterns, unlimited designs may be arranged for different settings. For example, a user can make his/her own design or customize an existing design based on the color of the paint of their wall or furniture.

In some embodiments, the felt tile kit also includes one or more adhesive devices. In some embodiments, the one or more adhesive devices include one or more double-sided adhesive tabs. One side of the double-sided adhesive tabs is configured to attach to a back surface of a felt tile. Another side of the double-sided adhesive tabs is configured to attached to a substantially flat surface (e.g., a wall or a floor). Because the felt tiles described herein are made of fibers (e.g., felt), they are very light compared to ceramic felt tiles. The adhesive used for the felt tiles described herein does not need to be permanent. In some embodiments, the one or more double-sided adhesive tabs can be easily applied and removed from a wall surface without damaging the wall surface. In some embodiments, the one or more adhesive devices include glue for more permanent attachment.

Figure 9:
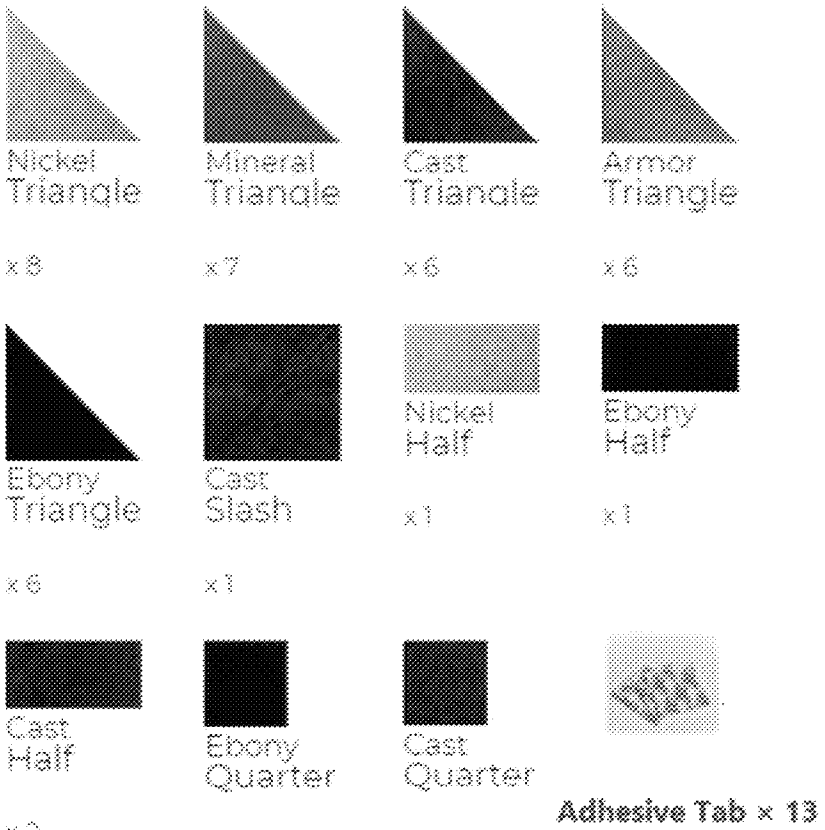
FIG. 9 illustrates an example of a tile kit having a set of different numbers of tiles having predetermined shapes and a number of adhesive tabs that are configured to form the mountain design of FIGS. 7 and 8.

FIG. 9 illustrates an example of a felt tile kit 900, corresponding to the mountain design 700, 800 of FIGS. 7 and 8. As illustrated, the felt tile kit 900 includes 8 nickel-colored triangle-shaped felt tiles, 7 mineral-colored triangle-shaped felt tiles, 6 cast-colored triangle-shaped felt tiles, 6 armor-colored triangle-shaped felt tiles, 6 ebony-colored triangle-shaped felt tiles, 1 cast-colored slash-shaped felt tile, a nickel-colored half-shaped felt tile, 1 ebony-colored half-shaped felt tile, 1 cast-colored half-shaped felt tile, 1 ebony-colored quarter-shaped felt tile, 1 cast-colored quarter-shaped felt tile, and 13 adhesive tabs. The triangle-shaped felt tile, the slash-shaped felt tile, the half-shaped felt tile, the quarter-shaped felt tile shown in FIGS. 7 and 8 may correspond to those-shaped felt tiles shown in FIG. 5. The nickel, mineral, cast, armor, ebony, cast colors may correspond to those colors shown in FIG. 6.

In some embodiments, each felt tile has a predetermined price, and the kit is charged based on the felt tiles included in the kit. As illustrated, each triangle felt tile can be manufactured and provided at relatively low cost, affordable for nearly any given budget. In some embodiments, a receipt including a list of all the felt tiles and their respective price and a total price is included in the felt tile kit.

In some embodiments, the tile kit also includes an instruction document having instructions for installing the tile kit. In some embodiments, the instruction document shows an arrangement of the design formed by the set of felt tiles in the tile kit (e.g., the design 700 of FIG. 7 or 800 of FIG. 8). In some embodiments, the instruction document also shows an instruction for applying the one or more adhesive devices. In some embodiments, for each of the predetermined shapes, the instruction document shows one or more locations on a felt tile having the shape, where the adhesive devices (e.g., double-sided adhesive tabs) should be applied.

Figure 10:
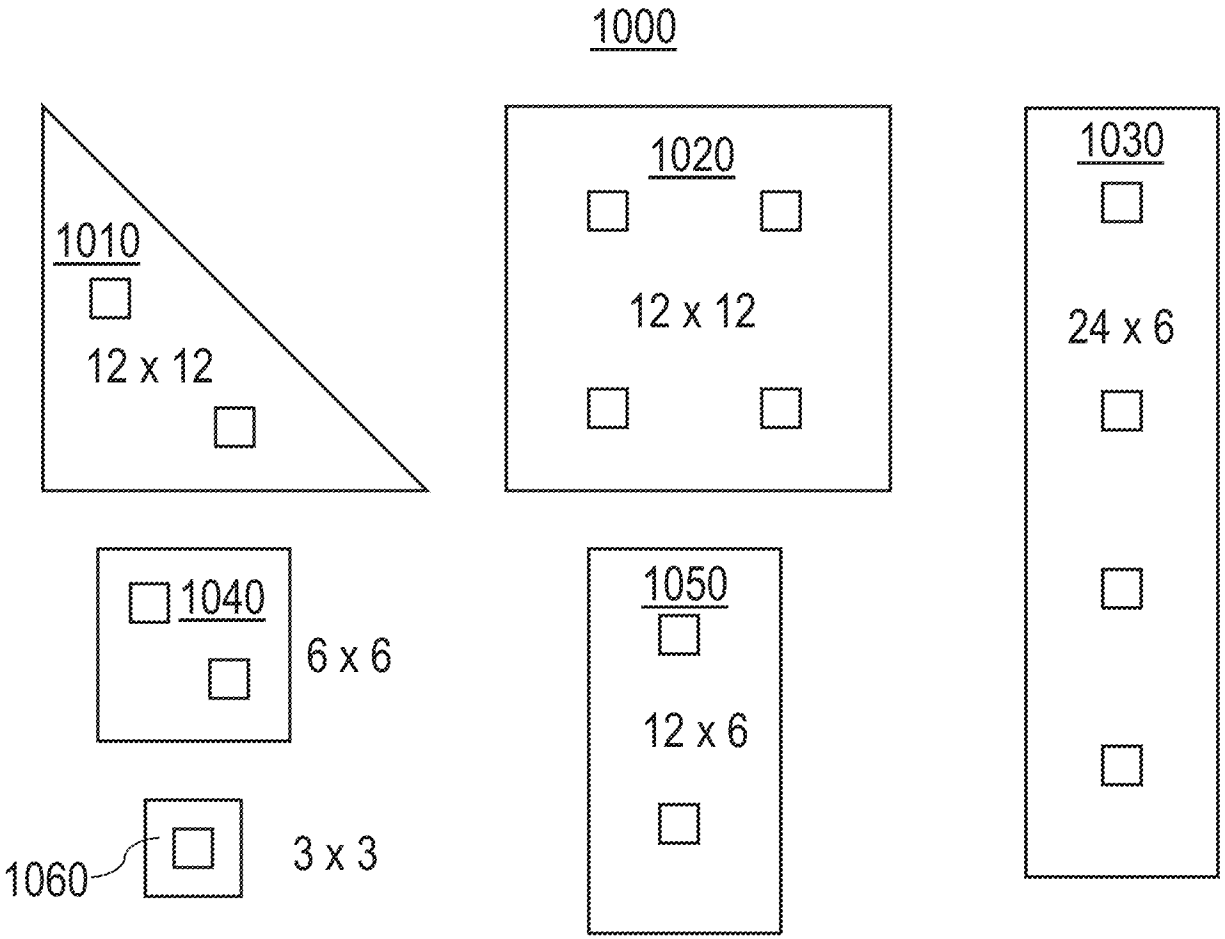
FIG. 10 illustrates an example of an instruction showing one or more locations on each shaped tile among multiple predetermined shapes where adhesive tabs should be applied.

FIG. 10 illustrates an example of a portion of the instruction document 1000 that shows one or more locations on a felt tile having the shape where the adhesive tabs are applied. As illustrated, two adhesive tabs should be applied on a triangle-shaped felt tile 1010, four adhesive tabs should be applied on a square-shaped felt tile 1020, three adhesive tabs should be applied on a shiplap-shaped felt tile 1030, two adhesive tabs should be applied on a quarter-shaped felt tile 1040, one adhesive tab should be applied on a pixel-shaped felt tile 1060, and two adhesive tabs should be applied on a half-shaped felt tile 1050. The triangle-shaped felt tile 1010, the square-shaped felt tile 1020, the shiplap-shaped felt tile 1030, the quarter-shaped felt tile 1040, the pixel-shaped felt tile 1060, and the half-shaped felt tile 1050 may correspond to those respective shaped felt tiles illustrated in FIG. 5.

The present invention may be embodied in other specific forms without departing from its spirit or characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. A tile, having a rigid body made of felt, wherein:

the rigid body has a top surface and a bottom surface that are parallel to each other;

the bottom surface is configured to be attached to a substantially flat surface;

an area of the top surface is smaller than an area of the bottom surface;

a distance between the top surface and the bottom surface is a thickness of the tile;

the thickness is no greater than 1 inch, the top surface and the bottom surface are geometrically similar, with the top surface being smaller than the bottom surface, and the rigid body of the tile comprises a plurality of side surfaces extending from the top surface to the bottom surface, the plurality of side surfaces consisting of:

a first set of side surfaces, each side surface of the first set of side surfaces being directly connected to the top surface, each side surface of the first set of side surfaces being not perpendicular to the top surface or the bottom surface, wherein the first set of side surfaces is disposed around all sides of a perimeter of the top surface; and a second set of side surfaces, each side surface of the second set of side surfaces being directly connected to the bottom surface, each side surface of the second set of side surfaces being perpendicular to the top surface, wherein the second set of side surfaces is disposed around all sides of a perimeter of the bottom surface, each side surface of the second set of side surfaces being directly connected to a corresponding side surface of the first set of side surfaces to form chamfered edges.

2. The tile of claim 1, wherein a thickness of the rigid body is about ⅓ of an inch.

3. The tile of claim 1, wherein the felt is made with at least 50% recycled content.

4. The tile of claim 1, wherein each of the first set of side surfaces and the top surface form an angle of about 45 degrees.

5. The tile of claim 1, wherein each of the second set of side surfaces has a width that is about 50% of the thickness of the rigid body.

6. The tile of claim 1, wherein:

the top surface further includes one or more grooves that form a pattern; and the pattern is configured to divide the top surface into a plurality of sections, causing the tile to appear to be a plurality of smaller tiles when viewed from a side of the top surface.

7. The tile of claim 6, wherein the rigid body has a particular color, a particular shape, or a particular pattern;

the particular color is selected from a plurality of predetermined colors; the particular shape is selected from a plurality of predetermined shapes; and the particular pattern is selected from a plurality of predetermined patterns.

8. A tile kit, comprising:

a plurality of tiles of claim 7, wherein:

each of the plurality of tiles has a color selected from the plurality of predetermined colors and a shape selected from the plurality of predetermined shapes; and the plurality of tiles is configured to form one or more designs.

9. The tile kit of claim 8, further comprising:

one or more adhesive devices configured to attach the plurality of tiles onto a substantially flat surface.

10. The tile kit of claim 9, wherein the one or more adhesive devices comprise a plurality of double-sided adhesive tabs, one side of each of the plurality of double-sided adhesive tabs is configured to be attached on the bottom surface of each of the plurality of tiles; and another side of each of the plurality of double-sided adhesive tabs is configured to be attached to the substantially flat surface.

11. The tile kit of claim 9, wherein the one or more adhesive devices comprise glue.

12. The tile kit of claim 9, further comprising an instruction document having instructions for installing the tile kit.

13. The tile kit of claim 12, wherein the instruction document shows an arrangement of the one or more designs formed by the plurality of tiles in the tile kit.

14. The tile kit of claim 12, wherein the instruction document shows an instruction for applying the one or more adhesive devices.

15. The tile kit of claim 14, wherein for each of the plurality of predetermined shapes, the instruction document shows one or more locations on a tile having the shape, where the one or more adhesive devices should be applied.

* * * * *